US008813856B1

(12) United States Patent
Brunet et al.

(10) Patent No.: US 8,813,856 B1
(45) Date of Patent: Aug. 26, 2014

(54) DOWNHOLE TUBING SHIFT TOOL AND METHOD

(76) Inventors: Charles Brunet, Houston, TX (US); Michel Bouchard, Calgary (CA); Kevin Mazarac, Houma, LA (US)

( * ) Notice: Subject to any disclaimer, the term of this patent is extended or adjusted under 35 U.S.C. 154(b) by 465 days.

(21) Appl. No.: 13/087,793

(22) Filed: Apr. 15, 2011

Related U.S. Application Data

(60) Provisional application No. 61/327,980, filed on Apr. 26, 2010.

(51) Int. Cl.
*E21B 7/08* (2006.01)

(52) U.S. Cl.
USPC ..... 166/383; 175/61; 175/75

(58) Field of Classification Search
USPC ..... 166/381, 383; 175/61, 75
See application file for complete search history.

(56) References Cited

U.S. PATENT DOCUMENTS

| | | | | |
|---|---|---|---|---|
| 3,552,509 | A * | 1/1971 | Brown | 175/258 |
| 5,392,858 | A * | 2/1995 | Peters et al. | 166/298 |
| 7,669,672 | B2 | 3/2010 | Brunet et al. | |
| 2002/0070018 | A1 | 6/2002 | Buyaert | |
| 2007/0125577 | A1 * | 6/2007 | Brunet | 175/62 |
| 2009/0101414 | A1 * | 4/2009 | Brunet et al. | 175/62 |

* cited by examiner

*Primary Examiner* — Cathleen Hutchins
(74) *Attorney, Agent, or Firm* — McGarry Bair PC

(57) ABSTRACT

A method and apparatus for selectively reciprocating a downhole device in a wellbore relative to an upper portion of production tubing, so that the upper portion of production tubing does not need to be lifted to operate the downhole device. A shift tool between the upper production tubing and the deflector assembly is designed to lift a deflector assembly independently of the upper production tubing. The shift tool is operated by pressurized fluid delivered from the surface, for example with a fluid-delivery device on the end of coiled tubing lowered through the production tubing.

17 Claims, 5 Drawing Sheets

38e
39
38d
38b
38
40
38a
34

32
32a
33
38c
38a
34
40
30
34a
34c
35
36
38
38d
34a
40
5C
38b
39
38a
38e 52a
52
53
54
58
54
50
56
53
59
60

DOWNHOLE TUBING SHIFT TOOL AND METHOD

CROSS REFERENCE TO RELATED APPLICATIONS

This application is related to and claims the benefit of U.S. Patent Application Ser. No. 61/327,980, filed Apr. 26, 2010, which is incorporated herein by reference in its entirety.

FIELD OF THE INVENTION

This invention relates to operating downhole oil and gas well devices from the surface of the earth. In one of its aspects, the invention relates to an apparatus for manipulating the reciprocation of a downhole devise from the surface of the earth without reciprocating a production tubing. In another of its aspects, the invention relates to a method for manipulation of a downhole devise that is axially reciprocated from a downhole location without reciprocating a connection between the surface of the earth and the downhole location. In another of its aspects, the invention relates to a method for controlling the indexing of a downhole borehole tool for drilling lateral boreholes in a producing foundation without reciprocation of the workstring or production tubing from the earth surface. In another of its aspects, the invention relates to an apparatus for controlling the indexing of a downhole borehole tool for drilling lateral boreholes in a producing foundation without reciprocation of the workstring or production tubing from the earth surface.

BACKGROUND OF THE INVENTION

In the type of hydrocarbon drilling operation where a drilling tool is redirected laterally through the side of a wellbore, it is common to use a downhole device known as a "deflector" depending from the lower end of the workstring or production tubing to "deflect" case-milling and drilling tools laterally. Where more than one lateral borehole is to be drilled from the wellbore, it is also common to reorient the deflector device by manipulating the workstring or production tubing (hereafter generally "tubing" or "production tubing") from the surface, for example by rotating and/or lifting the tubing up and down to operate an indexing device that rotates the deflector. These methods require expensive, slow, and/or difficult-to-move machinery on the surface to lift the entire production tubing.

One such indexing deflector device is shown and described in our U.S. Pat. No. 7,669,672 which is incorporated in its entirety by reference.

FIG. 1 schematically shows such a prior art indexing deflector assembly, which generally includes a retractable tubing anchor 22, a deflector shoe 20, an indexer tool 18, and a tube segment or connector or landing profile 17 for connecting the deflector shoe to the production tubing 14. Milling and drilling tools, for example a jetting nozzle 16*a*, are lowered into operative engagement with the deflector shoe 20 via coiled tubing 16. Tubing 14 may also be connected directly to deflector shoe 20.

Details of such deflector assemblies are known to those skilled in the art and are not necessary for an understanding of the present invention. However, for context, the tubing anchor 22 is a device that contains slip devices that are outwardly biased to contact and "dig" into the sidewalls of the wellbore casing 12. The tubing anchor 22 is operated either mechanically by rotation of the production tubing 14 from the surface, or hydraulically by fluid pressure. The deflector shoe 20 is a tubular piece with a curving channel or passage 20*a* milled through it from its upper end, the channel entering the upper end of the deflector shoe 20 with an orientation parallel to its long axis and exiting a side of the deflector shoe perpendicular to the long axis. The shoe 20 is connected at its lower end to indexer 18 and the tubing anchor 22 and at its upper end to the production tubing 14. The indexing tool 18 is connected to the deflector shoe 20 to reorient the deflector shoe 20 in the wellbore 10 in response to a combination of up-and-down reciprocation and rotation of the production tubing 14, and thus change the radial direction in which casing-milling and borehole-drilling devices such as 16*a* are redirected through the deflector shoe 20 to engage the wellbore casing 12 and the surrounding formation 11.

In the illustrated example, the indexing tool 18 consists of two main tubular components, with the main portion of the first tubular component having an outer diameter slightly less than the inside diameter of the main portion of the second tubular component. A pin located on the outside housing of the second tubular component travels within a J-slot opening machined into the outside wall of the first tubular component. This J-slot has several profiles that are repeated to create an "endless J" path. At the end of each profile is a landing in which the pin lands to cause the first tubular component to be locked with respect to the second tubular component. The production tubing 14 must be lifted while it is rotated to allow the first tubular component to shift position with respect to the second tubular component, and in turn rotate the deflector shoe 20.

BRIEF SUMMARY

According to the invention, a well bore comprises production tubing extending from the earth surface into a production strata beneath the earth surface and an indexing deflector assembly that has a deflector shoe directing a milling or drilling tool laterally of a a longitudinal axis of the production tubing and is mounted for axial reciprocation within the wellbore. An indexing device is connected to the deflector shoe to rotate the deflector shoe along a longitudinal axis of the production tubing when the deflector shoe is raised and lowered in the well bore. The indexing deflector assembly is connected to the production tubing in a downhole section of the wellbore distant from earth surface. A shift tool assembly is connected between the downhole device and a portion of the production tubing and is configured to sequentially lift and lower the deflector shoe relative to an upper portion of the production tubing to change the radial position of the deflector shoe.

In one embodiment, the shift tool assembly is responsive to fluid pumped from the surface to operate the downhole device with a reciprocating action, independent of the production tubing above the shift tool. The shift tool assembly is movable between an extended (unshifted) length and a retracted (shifted) length, and functions as a shiftable extension or section of the production tubing.

In one embodiment, the shift tool assembly has parts that are movable between an extended and a retracted position. The shift tool assembly can have an upper portion that is connected the production tubing and a movable fluid-delivery part that is mounted for longitudinal movement with respect to the production tubing.

In one embodiment, the fluid-delivery portion is operatively connected to a fluid conduit that carries pressurized fluid to the fluid-delivery device.

Further, the shift tool assembly can have a sub part that comprises outer and inner tubular portions defining a variable volume fluid chamber between them, the outer portion can be movable relative to the inner portion. The inner portion can be connected to the upper production tubing and the outer portion can be connected to the downhole device. Further, the inner portion can include a fluid path communicating with the variable volume chamber and with the fluid-delivery tool when the fluid-delivery tool is in operative contact with the shift tool.

The sub part can include a fluid release portion, and the fluid-delivery portion can comprise a fluid-release device activated by the fluid release portion when the fluid-delivery portion is in operative contact with the sub part. Further, the fluid release portion can include a profile, and the fluid-release device can be a check valve.

In one embodiment, the shift tool assembly is connected directly to the downhole device.

In another embodiment, the shift tool can be connected to the downhole device through a lower portion of production tubing.

In one embodiment, the downhole device can be a deflector assembly.

Further according to the invention, a method for reciprocating a deflector shoe in an indexing deflector assembly that is connected to production tubing in a downhole section of a wellbore distant from a surface location comprises: providing a shift tool comprising a pair of hollow cylinders that define between them variable volume chamber; placing the shift tool between the deflector shoe and an upper portion of the production tubing, introducing the fluid pressure to the variable volume fluid chamber of the shift tool to raise the deflector shoe without raising and lowering the upper portion of the production tubing, and subsequent to the act of introducing fluid pressure to the variable volume fluid chamber releasing fluid pressure from the variable volume fluid chamber to lower the deflector shoe without raising and lowering the upper portion of the production tubing.

In one form, the shift tool comprises a tubular sub part in a fixed location between the upper production tubing and the downhole device, and a movable fluid-delivery device (hereafter "stinger") that is lowered from the surface through the production tubing into and out of operative contact with the sub part, for example, on the end of coiled tubing.

The shift tool can be directly connected to the downhole device, or can be indirectly connected to the downhole device by a lower portion of production tubing or other connector extending downwardly from and shiftable with the shift tool.

The stinger in a preferred form is a male part received or "landed" in a female profile in the shift tool, the stinger including a fluid-release valve activated by operative positioning with the shift tool to release pressurized fluid into the shift tool to retract the shift tool. When the pressurized fluid is released to the shift tool, it produces a detectable pressure drop at the surface in the fluid pumped to the stinger. The detected pressure drop can be reflected in a pressure gauge at the surface and can be reflected in a visual signal for observation by an operator. Thus, the detected pressure drop signal indicates to an operator at the surface that the stinger has landed, and that the shift tool has retracted to lift and operate the downhole device.

In a particular form, the sub part of the shift tool comprises two tubular assemblies connected for reciprocal movement: an outer main cylinder with a stinger-landing profile at a lower end thereof, and an inner cylinder over which the outer cylinder moves. The outer and inner cylinder portions define a sealed, variable volume fluid chamber between them. The stinger is configured through size and shape to enter the inner cylinder and land a lower end on the outer cylinder's profile when the shift tool is extended, i.e. when the outer and inner cylinders are shifted apart their maximum distance. A fluid-releasing device on the stinger is activated by a fluid-releasing portion of the inner cylinder when the stinger and sub are in operative contact. A fluid port in the inner cylinder communicates the released fluid to the variable volume fluid chamber. The introduction of pressurized fluid into the variable volume chamber causes one of the cylinder assemblies to shift relative to the other, shortening the shift tool and lifting the downhole device without having to lift the upper portion of production tubing above the shift tool.

Still further according to the invention, a shift tool apparatus is designed for use in a well bore in which production tubing extends from the earth surface into a production strata beneath the earth surface and a downhole device is connected to the production tubing in a downhole section of the wellbore distant from earth surface and is configured with a part that is axial shiftable with respect to another part that is fixed within the wellbore for reciprocal movement within the well bore. The shift tool apparatus comprises:

- a hollow tubular sub comprising inner and outer hollow tubular cylinders mounted for reciprocal telescoping movement between a retracted position and an extended position, a fluid-delivery device; and a bottom sub fitting;
- the two hollow tubular cylinders form a sealed variable volume fluid chamber between them and a port in the iner tubular cylinder;
- the fluid delivery device is configured to mount to and end of a fluid delivery tubing at an open end and to move axially within the inner tubular cylinder, and further has an internal fluid path including the open end with a fluid release port that is selectively closed by a releasable valve;
- the bottom sub fitting is mounted to the outer tubular cylinder and is configured to receive a lower end of the fluid delivery device and further is configured to open the releasable valve in the fluid delivery device to open the fluid release port when the fluid delivery device is received in the bottom sub fitting; and
- wherein the fluid release port is in communication between the inlet opening in the inner tubular cylinder to pressurize the variable volume fluid chamber to move the inner and outer cylinders from the extended position to the retracted position.

The shift tool apparatus according to the invention is adapted to selectively shift the axially shiftable part of the downhole device independent of movement of the production tubing. Therefore, the production tubing does not need to be axially shifted to move the shiftable part of the downhole device.

While the invention is illustrated in connection with its preferred use, in a hydrocarbon producing wellbore with a deflector assembly, it can be used in any wellbore where a downhole device is operated by lifting and lowering an upper portion of production tubing.

These and other features and advantages of the invention will become apparent from the detailed description below, in light of the accompanying drawings.

DETAILED DESCRIPTION

Figure 1:
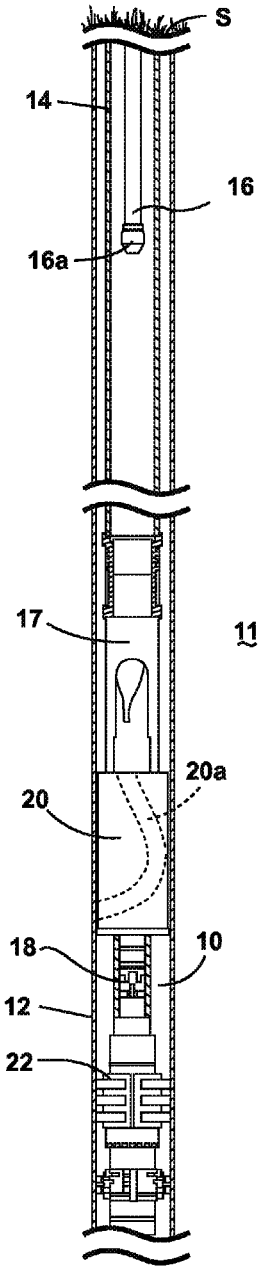
Fig. 1 (PRIOR ART)
FIG. 1 is a side elevation sectional view, partially cutaway, of a wellbore with a schematic representation of prior art production tubing and an indexing type deflector assembly.
Figure 2:
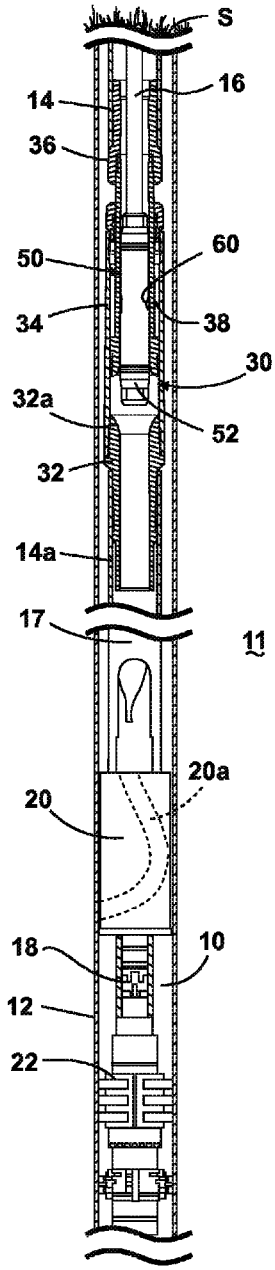
FIG. 2 illustrates the production tubing of FIG. 1, modified with a shift tool according to the invention above the deflector assembly, prior to its tool-shifting operation.

Referring first to FIG. 2, the production tubing 14 and a tubing-reciprocated downhole device in the form of deflector assembly 18, 20, 22 are connected through a shift tool 30. Shift tool 30 is shown in an exemplary and currently preferred form in order to teach how to make and use the claimed invention, and generally comprises a shiftable tubular assembly that also functions as a section of the production tubing 14; i.e., tools and fluids can pass through the shift tool 30 generally as though it were part of the production tubing above the deflector assembly.

Illustrated shift tool 30 is designed to be operated hydraulically with pressurized fluid delivered from surface S in the currently preferred and illustrated example with a movable fluid-delivering device 50 hereafter referred to as a "stinger". Stinger 50 is lowered mechanically from the surface, for example, on the end of standard coiled tubing 16. It will be understood after further explanation of the complementary operation of the stinger 50 with the shift tool 30 that other devices and methods could be used to operate shift tool 30, including, but not limited to, alternate sources of pressurized fluid supply and/or electromechanical devices powered by a cable in the coiled tubing 16 or with a battery pack located in or adjacent the shift tool 30. Accordingly, "shift tool" should be understood to include both the illustrated shift tool 30 and any operating device, whether the operating device is part of the shift tool 30 or is external to the shift tool 30, as in the case of stinger 50.

Shift tool 30 is shown connected at its upper end 36 to upper production tubing 14, for example, with a threaded connection or through an intermediate mechanical connector, and at its lower end through a connector or preferably through a length of lower production tubing 14*a* and/or landing profile 17 to deflector shoe 20. Any production tubing or equivalent above shift tool 30 will be considered "upper" tubing and any production tubing or equivalent below shift tool 30 will be considered "lower" tubing. Shift tool 30 could alternately be connected directly to deflector shoe 20.

Coiled tubing 16 (or equivalent movable fluid-delivery tubing) lowers stinger 50 through upper production tubing 14 from the surface S using known mechanisms for feeding and extracting coiled tubing from the surface. Stinger 50 is supplied with pressurized fluid (for example water or hydraulic fluid) through coiled tubing 16, which, as understood by those skilled in the art, is commonly used to deliver pressurized fluid downhole in a wellbore. FIG. 2 shows stinger 50 just before it is in full operative contact, or "landed", in shift tool 30. Once landed, stinger 50 is activated to release pressurized fluid into shift tool 30, causing tool 30 to retract and lift lower production tubing 14*a* and deflector shoe 20 (and any other movable portion of the deflector assembly) upwardly, as shown in FIG. 3, while upper production tubing 14 remains stationary.

Figure 3:
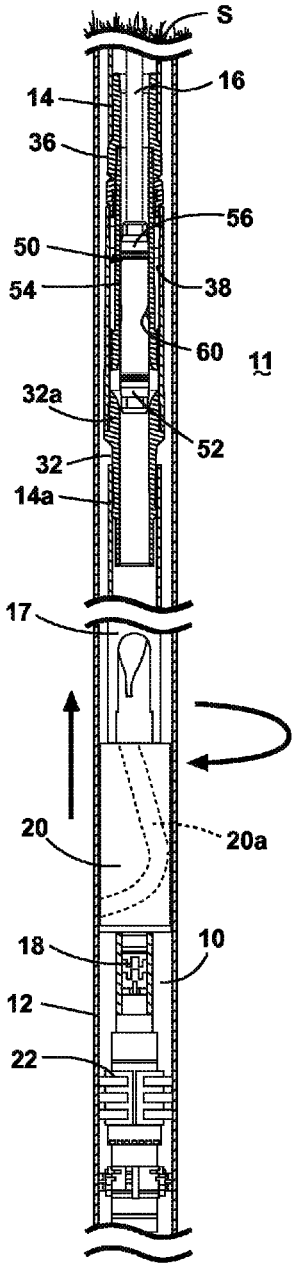
FIG. 3 is similar to FIG. 2, but shows the deflector assembly being lifted and rotated by retraction of the shift tool.

This lifting of deflector shoe 20 is used to rotate and reorient shoe 20, as shown by the arrows in FIG. 3, either due to the operation of an associated indexing device such as 18 and/or to a supplemental rotation of the upper production tubing 14 by other equipment, for example known tube-rotating equipment (not shown) on the surface S. Stinger 50 and coiled tubing 16 are lifted along with the deflector shoe 20 and lower tubing 14*a* when shift tool 30 retracts. Raising stinger 50 back out of operative connection with shift tool 30 causes shift tool 30 to return to its extended, unshifted condition as shown in FIG. 4, lowering tubing 14*a* and deflector shoe 20 and allowing any further rotation needed to index the shoe 20, as shown by the arrows in FIG. 4.

Figure 4:
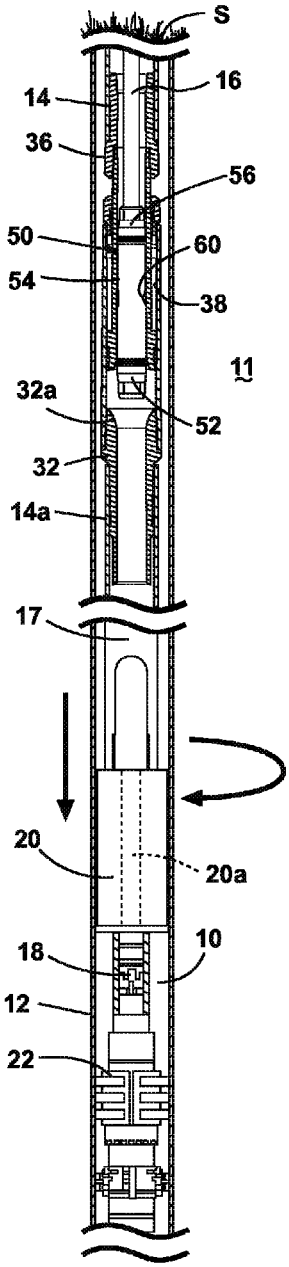
FIG. 4 is similar to FIG. 2, but shows the deflector assembly being lowered and rotated by the shift tool as it returns to its extended condition.

FIG. 4 shows stinger 50 raised a short distance, for example, six inches, out of operative, fluid-supplying contact with shift tool 30. The result is that shift tool 30 returns under the weight of the deflector assembly and lower tubing 14*a* to its "unshifted" or extended length, and deflector shoe 20 is lowered into to the next lateral drilling position. Deflector shoe 20 may already be fully rotated or "indexed" to the next drilling position when lifted as in FIG. 3, or it may complete its rotation to the next drilling position when lowered as in FIG. 4. The details of the operation of deflector assembly 18, 20, 22 are disclosed in the Brunet et al. U.S. Pat. No. 7,669,672 and may vary; the important aspect of the operation shown and described in FIGS. 3 and 4 is the reciprocation of the deflector assembly independently of the movement of the upper production tubing 14, effected by shift tool 30.

Although a short length of lower production tubing 14*a* is shown in the foreshortened examples of FIGS. 2 through 4, shift tool 30 and stinger 50 are capable of generating sufficient lifting force to lift hundreds of feet of lower production tubing 14*a* and any deflector or other downhole device at its lower end, using conventional coiled tubing 16 and conventional pressurized fluid supplies.

Figures 5A, 5B, 5C:
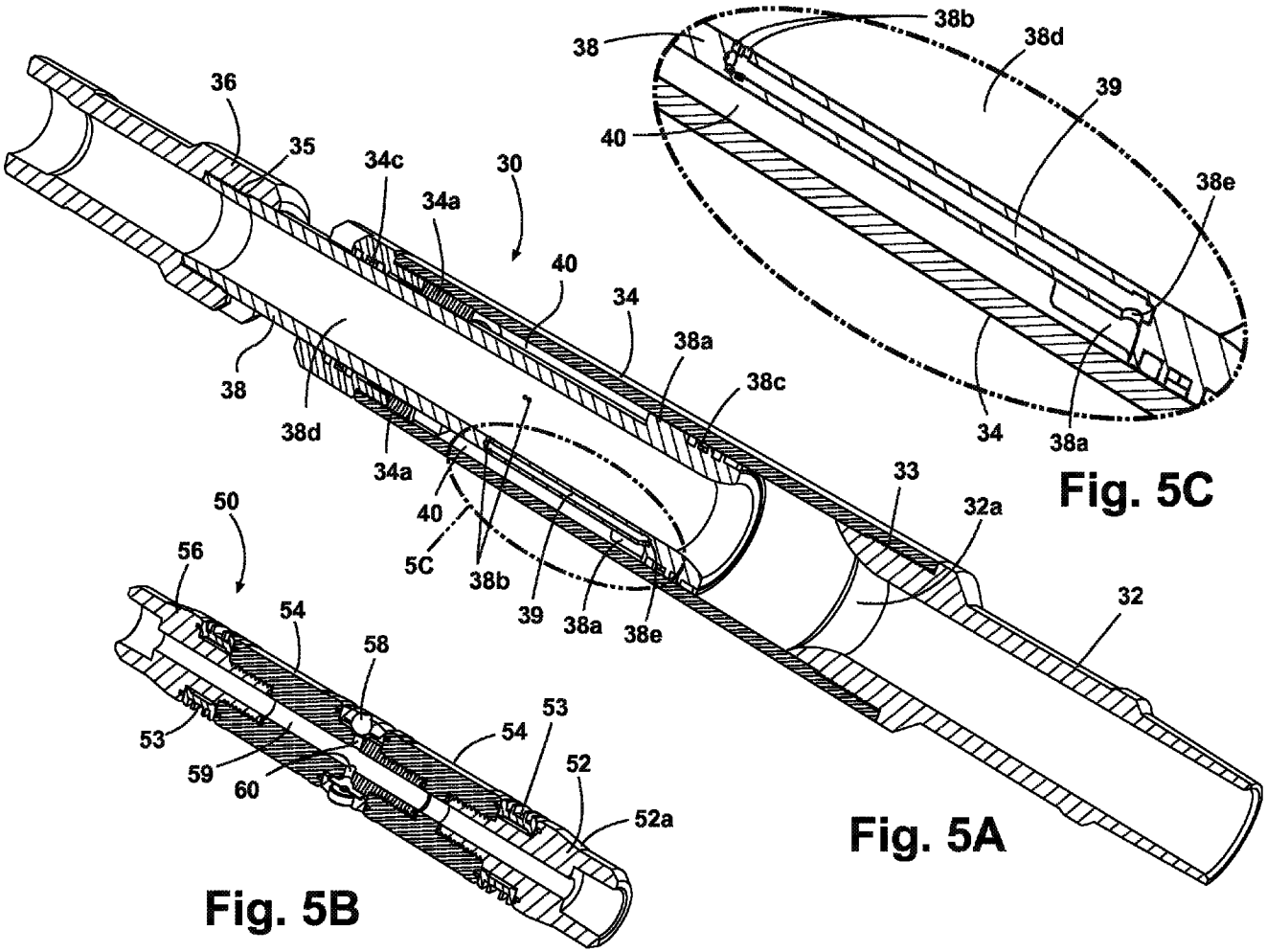
FIGS. 5A and 5B are perspective cutaway views of the fluid-responsive ("sub") and fluid-delivering ("stinger") portions of a preferred example of a shift tool assembly according to the invention.
FIG. 5C is an enlarged view of that portion of FIG. 5A within the dotted line 5C.

FIGS. 5A, 5B and 5C show perspective detail of the shift tool 30 and stinger 50. Shift tool 30 includes a bottom sub fitting 32 with a landing profile 32*a*; a main cylinder 34 secured to bottom sub 32, for example with threaded connection 33; a top sub fitting 36 secured at its upper end to upper production tubing 14 (FIGS. 2-4)); and a piston ram 38 secured to top sub fitting 36, for example, with a threaded connection 35. Sub 32 is connected at its lower end to lower production tubing 14*a* (FIGS. 2-4). Main cylinder 34 is slidably movable over the outside of piston ram 38 and has an inner diameter approximating the outer diameter of external piston ram lugs 38*a* and internal lugs 34*a* with an inner diameter matching the outer diameter of piston ram 38. Main cylinder 34 is limited in its upward movement by contact with top sub 36 and/or by contact between the upper end of bottom sub 32 and the lower end of piston ram 38. A variable volume chamber 40 is defined between internal lugs 34*a* on main cylinder 34 and external lugs 38*a* on piston ram 38.

Still referring to FIGS. 5A and 5B, the variable volume fluid chamber 40 between main cylinder 34 and piston ram 38 is hydraulically sealed by one or more seals 38*c* formed annularly around the outer surface of piston ram 38 below lugs 38*a* on the upper and lower ends of the stinger, and by one or more seals 34*c* formed annularly around the inner surface of main cylinder 34 above lugs 34*a*. The seals 34*c* and 38*c* may comprise multiple seals and/or different types of seal, for example Teflon seals, rope dirt seals, and bronze wear rings in sliding, sealing contact with the respective surfaces of main cylinder 34 and piston ram 38. The variable volume fluid chamber 40 has elongated channels 39 that communicates with interior bore 38*d* of the piston ram 38 through ports 38*b* and the stinger port 38*e* as shown more clearly in FIG. 5C. Landing profile 32*a* on the lower end of shift tool 30 is shaped to receive and stop a mating bevel or outer surface contour 52*a* on the lower end of the stinger 50. As the pressurized fluid is released into the chamber 40, a detectable pressure drop can be gauged by an operator at the surface to determine that the stinger 50 has been landed in shift tool 30.

Stinger 50 includes a fluid release port 60 closed by a check valve 58, for example a spring-loaded ball valve. Stinger 50 includes one or more internal fluid paths 59 communicating with coiled tubing 16 through upper end 56 and with fluid release port 60. When the lower end profile 52*a* of the stinger 50 lands on the profile 32*a*, the check valves 58 will be depressed by the profile of the interior bore 38*d* and will open to discharge pressurized fluid F from the coiled tubing, thereby releasing the shift-activating fluid F into chamber 40 and resulting in a pressure drop that can be gauged by an operator at the surface as an indication that the stinger 50 has been landed in shift tool 30. As pressurized fluid F from coiled tubing 16 flows from port 60 into shift tool 30, the fluid flows through holes 38*b*, through channels 39 and through stinger port 38*e* into variable volume chamber 40. The pressure of the fluid F in variable chamber 40 will shift the shift tool 30 to a retracted position as shown in FIG. 6C. As this shift takes place, the stinger 50 will maintain contact with the landing profile 32*a* of the bottom sub 32 and will move axially with respect to the shift tool 30. However, the fluid continues to flow to the variable volume 40 from the stinger 50 due to the channels 54 on the outer diameter of the stinger 50.

Stinger 50 includes upper and lower seals such as those shown at 53, for example, floating ring seals, to hydraulically seal the landed stinger 50 relative to the interior of piston ram 38. These floating seals ensure that the fluid released through valve 58 is supplied at high pressure to fluid holes 38*a* for activation of the shift tool, without pressure loss into the production tubing above or below the shift tool. The contoured, beveled leading and following ends of the stinger at 52*a* help passively center it with mating contours or profiles in the shift tool 30, and can be supplemented with more active centralizing devices such as spring-loaded centralizing lugs or bow spring type centralizer assemblies to further center and stabilize the stinger as it travels downhole and after it has landed in the shift tool 30.

The main tubular portions of the shift tool 30 and stinger 50 can be made from single pieces of material, or can be multi-piece assemblies as illustrated. Suitable materials for the main tubular body and end portions of the shift tool 30 and stinger 50 include high strength carbon or stainless steel, aluminum, and/or high-density plastics, without limitation. The various threaded connections shown are presently preferred, but other forms of connection may be used. Specifics of valves, seals, springs, and fluid passages may vary. These are just some of the possible ways in which shift tool and stinger can be varied from the illustrated examples.

Figure 6A:
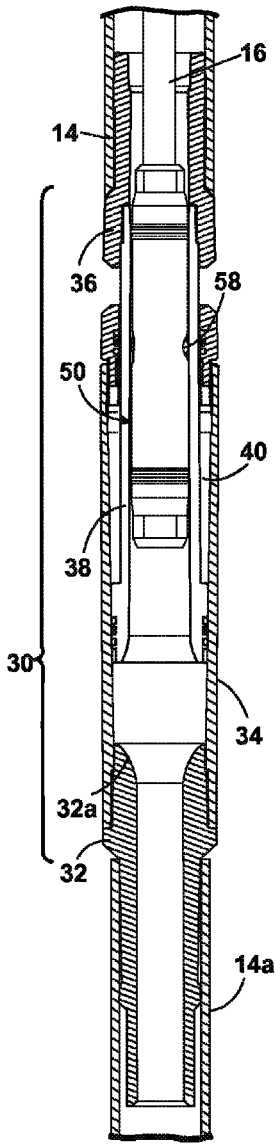
FIGS. 6A-6C are side cutaway views of the shift tool of FIGS. 2-4 in unshifted extended, partially shifted, and fully shifted retracted positions, respectively.
Figure 6B:
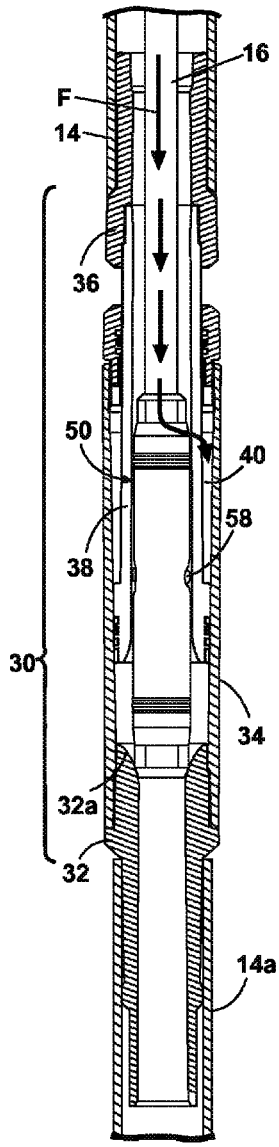
Figure 6C:
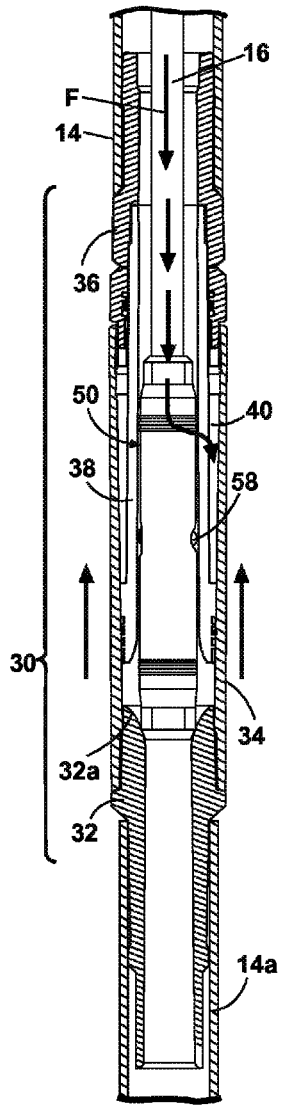

FIGS. 6A through 6C show the detailed operation of shift tool 30 with stinger 50. FIG. 6A shows stinger 50 entering shift tool 30, prior to landing on sub profile 32*a*, with shift tool 30 in its extended or "unshifted" position. FIG. 6B shows stinger 50 landed on profile 32*a* in bottom sub part 32 of shift tool 30, with a beveled lower end 52 of the stinger mating with the angled surface of profile 32*a*. This is the operative connection position, in which pressurized fluid F from coiled tubing 16 is released from stinger 50 into the variable volume chamber 40 between the outer and inner tubular portions 34 and 38 of the shift tool 30. When stinger 50 is landed on profile 32*a* as shown in FIG. 6B, check valve 58 is forced inwardly by the interior surface 38*d*, thereby releasing pressurized fluid into an annular space between the channels 54 in the outer surface of the stinger 50 and the inner surface 38*d* of the piston ram 38 (FIG. 5A) and into the variable volume chamber 40 via ports 38*b* and channels 39. Pressurized fluid F then flows from stinger 50 into the shift tool 30, specifically through ports 38*b*, the channels 39 in the piston ram 38, through the stinger port 38*e* into variable volume chamber 40 between the piston ram 38 and main cylinder 34.

In FIGS. 6B and 6C, the pressure of fluid F in chamber 40 acts on the internal lugs 34*a* of main cylinder 34 and the external lugs 38*a* of piston ram 38 to begin forcing cylinder 34, and thus bottom sub 32 and the downhole device and/or production tubing attached below it, upwardly over the piston ram 38, which is fixed via top sub 36 to upper production tubing 14. FIG. 6B shows shift tool 30 partially shifted, and FIG. 6C shows shift tool 30 fully shifted to the retracted position with cylinder 34 stopped against the lower end of top sub 36.

Description of Operation

In operation, the shift tool 30 is attached to the deflector assembly and production tubing at the surface, and installed in the wellbore 10 as if it were part of the production tubing above the deflector assembly. The deflector assembly 18, 20, 22 is used normally for a casing-milling or lateral drilling operation, for example with a milling or drilling tool lowered with coiled tubing 16 to be redirected laterally through the deflector shoe 20. After a hole is milled in the casing 12 or after a lateral borehole is completed, the milling or drilling tool is withdrawn to the surface, and stinger 50 is connected to the end of the coiled tubing 16. Stinger 50 is lowered into operative contact with shift tool 30, releasing fluid from the coiled tubing 16 into the shift tool 30 to retract the shift tool and lift the movable parts of the deflector assembly and any intermediate lower production tubing such as 14*a*. At the same time the operator on the surface may notice a pressure drop via a pressure gauge measuring the pressure of the fluid in the coiled tubing; this pressure drop is an indication that the downhole device has been lifted, and can mark the coiled tubing accordingly. The operator can then retract stinger 50 a few inches and wait until a pressure increase is seen, and then re-lower the stinger to operate the shift tool, or withdraw the stinger to the surface and resume milling or jetting operations.

Figure 7:
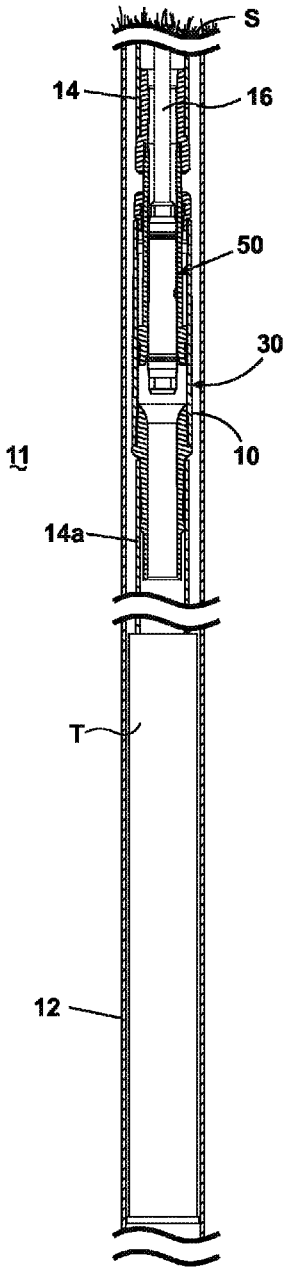
FIG. 7 is similar to FIG. 2, but shows the deflector assembly replaced with a generic, schematically drawn downhole device.

Again, while the shift tool is illustrated for lifting an indexing type deflector assembly, the shift tool could be used on different types of downhole tubing to reciprocate different types of downhole devices (including sections of downhole tubing) up and down without having to lift the tubing above it. FIG. 7 is a schematic representation of such a downhole device T in place of the deflector assembly illustrated in FIGS. 1-6B.

In the preceding description, various aspects and examples and configurations of making and using the invention as defined by the claimed subject matter have been described for purposes of explanation, to provide a thorough understanding of the invention, and to enable those skilled in the art to make and use the invention. However, these are merely example illustrations and descriptions of inventive concepts, and the scope of invention is not limited in these respects. It should be apparent to one skilled in the art having the benefit of this disclosure that the invention as defined by the claimed subject matter may be practiced without being limited to the specific details of the disclosure. In other instances, well-known features may have been omitted and/or simplified so as not to obscure the invention. While certain features have been illustrated and/or described herein, many modifications, substitutions, changes and/or equivalents are possible within the scope of the foregoing description and drawings. It is, therefore, to be understood that the appended claims are intended to cover all such modifications and/or changes as fall within the true spirit of invention as reflected by the preceding disclosure. It should further be understood that to the extent the term "invention" is used in the written specification, it is not to be construed as a limiting term as to number or type of claimed or disclosed inventions or the scope of any such invention, and does not exclude discoveries or designs; rather, it is a term which has long been conveniently and widely used to describe new and useful improvements in technology and as convenient shorthand for the claimed subject matter.

What is claimed:

1. In a wellbore comprising production tubing extending from the earth surface into a production strata beneath the earth surface and an indexing deflector assembly that has a deflector shoe directing a milling or drilling tool laterally of a longitudinal axis of the production tubing and is mounted for axial reciprocation within the wellbore and an indexing device connected to the deflector shoe to rotate the deflector shoe about a longitudinal axis of the production tubing when the deflector shoe is raised and lowered in the well bore; wherein the indexing deflector assembly is connected to the production tubing in a downhole section of the wellbore distant from earth surface; and a shift tool assembly connected between the downhole device and a portion of the production tubing, the shift tool assembly is configured to sequentially lift and lower the deflector shoe relative to an upper portion of the production tubing to change the radial position of the deflector shoe.

2. The wellbore of claim 1, wherein the shift tool assembly is responsive to pressurized fluid delivered from the surface to lift the deflector shoe.

3. The wellbore of claim 2, wherein the shift tool assembly has an upper portion that is connected to the production tubing, and has a movable fluid-delivery part that is mounted for longitudinal movement with respect to the production tubing.

4. The wellbore of claim 3, wherein the fluid-delivery portion is operatively connected to a fluid conduit that carries pressurized fluid to the fluid-delivery device.

5. The wellbore of claim 3, wherein the shift tool assembly has a sub part that comprises outer and inner hollow tubular portions defining a variable volume fluid chamber between them, the outer portion is movable relative to the inner portion, the inner portion is connected to the upper production tubing and the outer portion is connected to the downhole device, and the inner portion comprises a fluid path communicating with the variable volume chamber and with the fluid-delivery tool when the fluid-delivery tool is in operative contact with the shift tool.

6. The wellbore of claim 3, wherein the sub part comprises a fluid release portion, and the fluid-delivery portion comprises a fluid-release device activated by the fluid release portion when the fluid-delivery portion is in operative contact with the sub part.

7. The wellbore of claim 6, wherein the fluid release portion comprises a bore, and the fluid-release device comprises a check valve.

8. The wellbore of claim 1, wherein the shift tool assembly has parts that are movable between an extended and a retracted position.

9. The wellbore of claim 1 wherein the shift tool is connected directly to the deflector shoe.

10. The wellbore of claim 1, wherein the shift tool is connected to the deflector shoe through a lower portion of production tubing.

11. A method for controlling reciprocation of a deflector shoe in an indexing deflector assembly that is connected to production tubing in a downhole section of a wellbore distant from a surface location comprising:

providing a shift tool comprising a pair of hollow cylinders that define between them a variable volume fluid chamber;

placing the shift tool between the deflector shoe and an upper portion of the production tubing;

introducing fluid pressure to the variable volume fluid chamber of the shift tool to raise the deflector shoe without raising and lowering the upper portion of the production tubing; and subsequent to the act of introducing fluid pressure to the variable volume fluid chamber, releasing fluid pressure from the variable volume fluid chamber to lower the deflector shoe without raising and lowering the upper portion of the production tubing.

12. The method of claim 11 wherein the introducing act comprises the applying fluid pressure from the surface location to the shift tool.

13. A shift tool apparatus for use in a well bore in which production tubing extends from the earth surface into a production strata beneath the earth surface and a downhole device is connected to the production tubing in a downhole section of the wellbore distant from earth surface and the downhole device is configured with a part that is axially shiftable with respect to another part that is fixed within the wellbore for axial reciprocation within the wellbore, the shift tool apparatus comprising:

a hollow tubular sub comprising inner and outer hollow tubular cylinders mounted for reciprocal telescoping movement between a retracted position and an extended position, a fluid-delivery device; and a bottom sub fitting;

the two hollow tubular cylinders form a sealed variable volume fluid chamber between them and a port in the inner tubular cylinder;

the fluid delivery device is configured to mount to an end of a fluid delivery tubing at an open end and to move axially within the inner tubular cylinder, and further has an internal fluid path including the open end with a fluid release port that is selectively closed by a releasable valve;

the bottom sub fitting is mounted to the outer tubular cylinder and is configured to receive a lower end of the fluid delivery device and further is configured to open the releasable valve in the fluid delivery device to open the fluid release port when the fluid delivery device is received in the bottom sub fitting; and wherein the fluid release port is in communication between the inlet opening in the inner tubular cylinder to pressurize the variable volume fluid chamber to move the inner and outer cylinders from the extended position to the retracted position.

14. The shift tool apparatus of claim 13 and further comprising axially spaced seals between fluid delivery device and the inner tubular surface and the fluid release port is positioned between the spaced seals.

15. In a wellbore comprising production tubing extending from the earth surface into a production strata beneath the earth surface and a downhole device that is mounted for axial reciprocation within the wellbore wherein the downhole device is connected to a lower portion of the production tubing in a downhole section of the wellbore distant from earth surface, a shift tool apparatus according to claim 13 wherein the hollow tubular sub is mounted between a lower portion of the production tubing and the downhole device, and the fluid delivery device is mounted to a lower end of a moveable fluid-delivery tubing that extends down from the earth surface to the hollow tubular sub.

16. The wellbore of claim 15 wherein the outer hollow tubular cylinder is mounted to the downhole device and the inner hollow tubular cylinder is mounted to the production tubing.

17. The wellbore of claim 15 wherein the downhole device is an indexing deflector assembly that has a deflector shoe directing a milling or drilling tool laterally of a longitudinal axis of the production tubing and an indexing device connected to the deflector shoe to rotate the deflector shoe about a longitudinal axis of the production tubing when the deflector shoe is raised and lowered in the well bore.

* * * * *